US010830445B2

(12) United States Patent
Shershnyov et al.

(10) Patent No.: US 10,830,445 B2
(45) Date of Patent: Nov. 10, 2020

(54) LIQUID FUEL NOZZLES FOR DUAL FUEL COMBUSTORS

(71) Applicant: General Electric Company, Schenectady, NY (US)

(72) Inventors: Borys Shershnyov, Moscow (RU); Geoffrey David Myers, Greenville, SC (US); Alexey Yurievich Gerasimov, Moscow (RU); Michael Draisey, Greenville, SC (US)

(73) Assignee: General Electric Company, Schenectady, NY (US)

( * ) Notice: Subject to any disclaimer, the term of this patent is extended or adjusted under 35 U.S.C. 154(b) by 46 days.

(21) Appl. No.: 15/780,496

(22) PCT Filed: Dec. 30, 2015

(86) PCT No.: PCT/RU2015/000957
§ 371 (c)(1),
(2) Date: May 31, 2018

(87) PCT Pub. No.: WO2017/116266
PCT Pub. Date: Jul. 6, 2017

(65) Prior Publication Data

US 2018/0356097 A1 Dec. 13, 2018

(51) Int. Cl.
*F23R 3/36* (2006.01)
*F23R 3/34* (2006.01)
(Continued)

(52) U.S. Cl.
CPC ..... *F23R 3/36* (2013.01); *F23D 11/104* (2013.01); *F23D 11/106* (2013.01); *F23D 11/16* (2013.01);
(Continued)

(58) Field of Classification Search
CPC ..... F23R 3/36
See application file for complete search history.

(56) References Cited

U.S. PATENT DOCUMENTS 3,474,970 A * 10/1969 Hogg ..... F23D 11/107 239/404
4,854,127 A 8/1989 Vinson et al.
(Continued)

FOREIGN PATENT DOCUMENTS

EP 2 402 652 A1 1/2012
GB 2035540 A * 6/1980 ..... F02C 3/30
(Continued)

OTHER PUBLICATIONS

International Search Report and Written Opinion issued in connection with corresponding PCT Application No. PCT/RU2015/000957 dated Sep. 29, 2016.
(Continued)

*Primary Examiner* — Gerald L Sung
*Assistant Examiner* — Marc J Amar
(74) *Attorney, Agent, or Firm* — Dority & Manning, P.A.

(57) ABSTRACT

A nozzle for a combustor is disclosed. The nozzle may include a main fuel passage (202), a number of radial fuel ports (206) in communication with the main fuel passage, a prefilmer surface (212) in communication with the radial fuel ports, and a main purge air passage (218) in communication with the radial fuel ports and the prefilmer surface.

20 Claims, 3 Drawing Sheets

(51) Int. Cl.

| | |
|---|---|
| ***F23D 11/10*** | (2006.01) |
| ***F23D 11/16*** | (2006.01) |
| ***F23D 11/38*** | (2006.01) |
| ***F23R 3/28*** | (2006.01) |
| ***F23R 3/30*** | (2006.01) |
| ***F23D 17/00*** | (2006.01) |

(52) U.S. Cl.
CPC ..... *F23D 11/38* (2013.01); *F23D 17/002* (2013.01); *F23R 3/28* (2013.01); *F23R 3/286* (2013.01); *F23R 3/30* (2013.01); *F23R 3/343* (2013.01); *F23D 2900/11101* (2013.01)

(56) References Cited

U.S. PATENT DOCUMENTS 5,115,634 A * 5/1992 Bretz ..... B05B 7/066 60/778
5,224,333 A * 7/1993 Bretz ..... B05B 7/066 60/740
6,068,470 A * 5/2000 Zarzalis ..... F23D 11/007 239/403
6,272,840 B1 * 8/2001 Crocker ..... F02C 7/22 239/404
6,418,726 B1 * 7/2002 Foust ..... F23R 3/14 60/748
7,942,003 B2 * 5/2011 Baudoin ..... F23R 3/343 60/747
8,297,057 B2 * 10/2012 Toon ..... F23D 14/74 60/746
8,607,571 B2 * 12/2013 Williams ..... F23R 3/286 60/743
8,910,483 B2 * 12/2014 Von Der Bank ..... F23R 3/32 60/737
9,109,553 B2 * 8/2015 Matsuyama ..... F02M 23/12
9,562,691 B2 * 2/2017 Ford ..... F23R 3/30
2002/0162333 A1 11/2002 Zelina
2007/0157617 A1 * 7/2007 von der Bank ..... F23R 3/32 60/743
2009/0255263 A1 * 10/2009 Doerr ..... F23R 3/28 60/746
2010/0308135 A1 * 12/2010 Yamamoto ..... F23R 3/343 239/402
2011/0067403 A1 * 3/2011 Williams ..... F23R 3/343 60/742
2012/0292408 A1 * 11/2012 Short ..... F23D 11/103 239/463
2012/0305673 A1 * 12/2012 Matsuyama ..... F23R 3/343 239/533.2
2013/0177858 A1 * 7/2013 Boardman ..... F23C 7/004 431/9
2013/0186057 A1 * 7/2013 Shanmugam ..... F02C 3/20 60/39.463
2013/0291547 A1 * 11/2013 Ochiai ..... F02C 7/00 60/772
2013/0327849 A1 * 12/2013 Matsuyama ..... F23R 3/286 239/406
2016/0252254 A1 * 9/2016 Bottcher ..... F23R 3/286 60/39.463
2017/0038074 A1 * 2/2017 Myers ..... F23R 3/343
2017/0176000 A1 * 6/2017 Shershnyov ..... F23D 11/16

FOREIGN PATENT DOCUMENTS

WO 2015/174880 A1 11/2015
WO WO-2015174880 A1 * 11/2015 ..... F23R 3/343

OTHER PUBLICATIONS

International Preliminary Report on Patentability issued in connection with corresponding PCT Application No. PCT/RU2015/000957 dated Jul. 3, 2018.

* cited by examiner

LIQUID FUEL NOZZLES FOR DUAL FUEL COMBUSTORS

FIELD OF THE DISCLOSURE

Embodiments of the present disclosure relate generally to gas turbine engines and more particularly relate to liquid fuel nozzles for dual fuel combustors.

BACKGROUND

A dual fuel combustor may use a gas or a liquid fuel. In some instances, when operating a combustor using a liquid fuel, such as oil or the like, water may be injected into the liquid fuel to lower the combustion gas temperature and reduce NOx emissions. However, the use and storage of water may increase the overall costs of operating a gas turbine engine. In addition, water injection may decrease thermal efficiency.

BRIEF DESCRIPTION

Some or all of the above needs and/or problems may be addressed by certain embodiments of the present disclosure. According to an embodiment, there is disclosed a nozzle for a combustor. The nozzle may include a main fuel passage, a number of radial fuel ports in communication with the main fuel passage, a prefilmer surface in communication with the radial fuel ports, and a main purge air passage in communication with the radial fuel ports and the prefilmer surface.

According to another embodiment, there is disclosed a liquid fuel nozzle for a dual fuel combustor. The nozzle may include a main fuel passage, a number of radial fuel ports in communication with the main fuel passage, a prefilmer surface in communication with the radial fuel ports, a main purge air passage in communication with the radial fuel ports and the prefilmer surface, a pilot fuel passage, and a number of pilot purge air passages disposed between the radial fuel ports.

Further, according to another embodiment, there is disclosed a system including a combustor in a gas turbine engine and a nozzle disposed within the combustor. The nozzle may include a main fuel passage, a number of radial fuel ports in communication with the main fuel passage, a prefilmer surface in communication with the radial fuel ports, and a main purge air passage in communication with the radial fuel ports and the prefilmer surface.

Other embodiments, aspects, and features of the disclosure will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale.

DETAILED DESCRIPTION

Illustrative embodiments will now be described more fully hereinafter with reference to the accompanying drawings, in which some, but not all embodiments are shown. The present disclosure may be embodied in many different forms and should not be construed as limited to the embodiments set forth herein. Like numbers refer to like elements throughout.

Illustrative embodiments are directed to, among other things, a liquid fuel nozzle for a dual fuel combustor. In some instances, the nozzle may be a backup nozzle for a backup fuel in the dual fuel combustor. The nozzle may reduce water consumption while meeting NOx emissions requirements. Moreover, the nozzle may reduce the air needed for thermal protection while providing an air curtain for improved durability of the nozzle and the combustor liner.

The nozzle may be incorporated into any of several fuel gas/air mixers, including, but not limited to, a micro-mixer nozzle and/or a swirler nozzle ("swozzle"). For example, the nozzle may be disposed between a number of micro-tubes in an annular configuration and/or centrally located in a micro-mixer nozzle. Moreover, the nozzle may be disposed between a number of swirlers and/or centrally located in a swozzle. The nozzle may be incorporated into any combustor gas fuel nozzle.

Generally speaking, the nozzle may include a main liquid fuel passage, a number of radial fuel ports in communication with the main fuel passage, a prefilmer surface in communication with the radial fuel ports, and a main purge air passage in communication with the radial fuel ports and the prefilmer surface. In some instances, the radial fuel ports may include varying diameters. The liquid fuel nozzle also may include a radial lip spaced apart from the prefilmer surface adjacent to the radial fuel ports.

The main purge air passage may include a first outlet at a first end of the prefilmer surface adjacent to the radial fuel ports. The main purge air passage also may include a number of second outlets at a second end of the prefilmer surface opposite the radial fuel ports. In some instances, the main purge air passage may be at least partially disposed on a backside of the prefilmer surface. In addition, the main purge air passage may include an annular slot.

The liquid fuel nozzle also may include a pilot fuel passage and a number of pilot purge air passages disposed between the radial fuel ports. The pilot purge air passages may include varying diameters.

Figure 1:
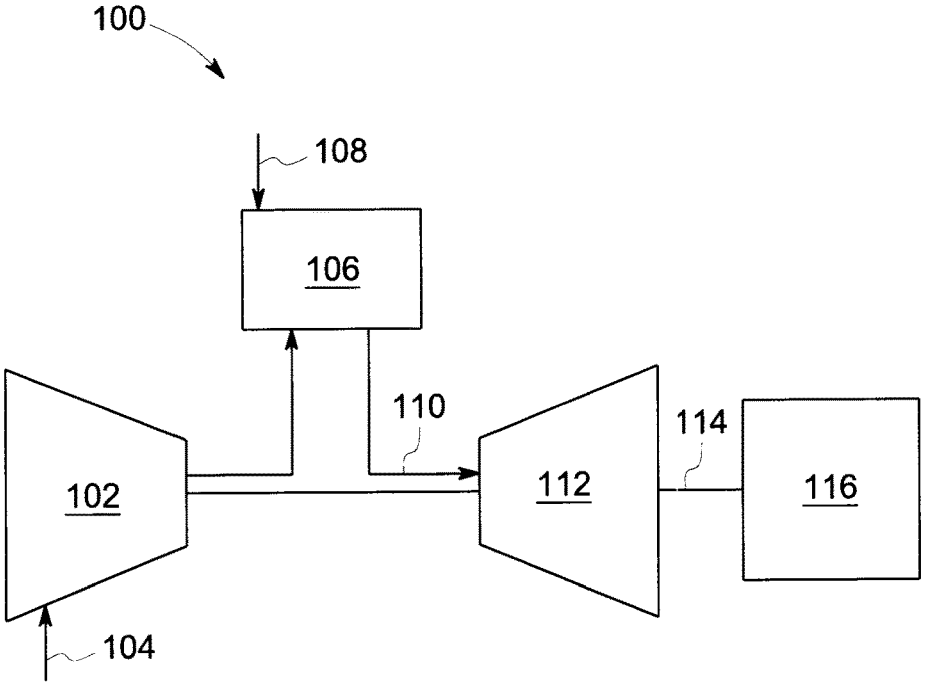
FIG. 1 schematically depicts of an example gas turbine engine according to an embodiment.
Figure 2:
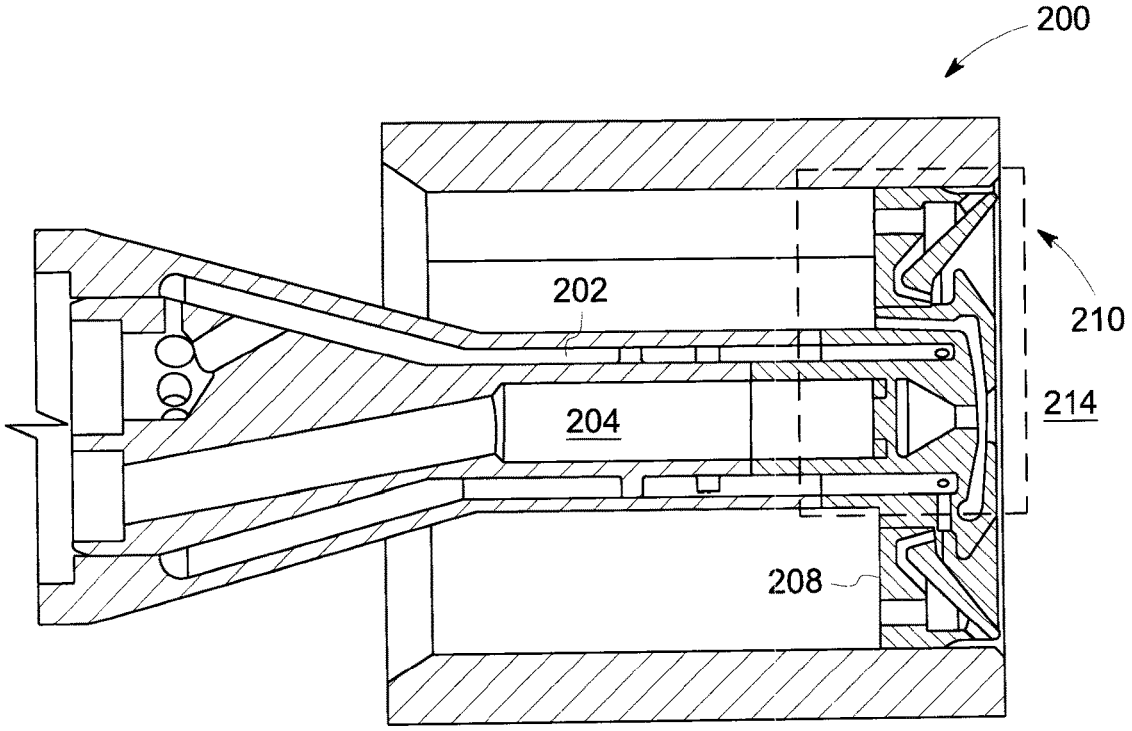
FIG. 2 schematically depicts a cross-sectional view of an example liquid fuel nozzle according to an embodiment.
Figure 3:
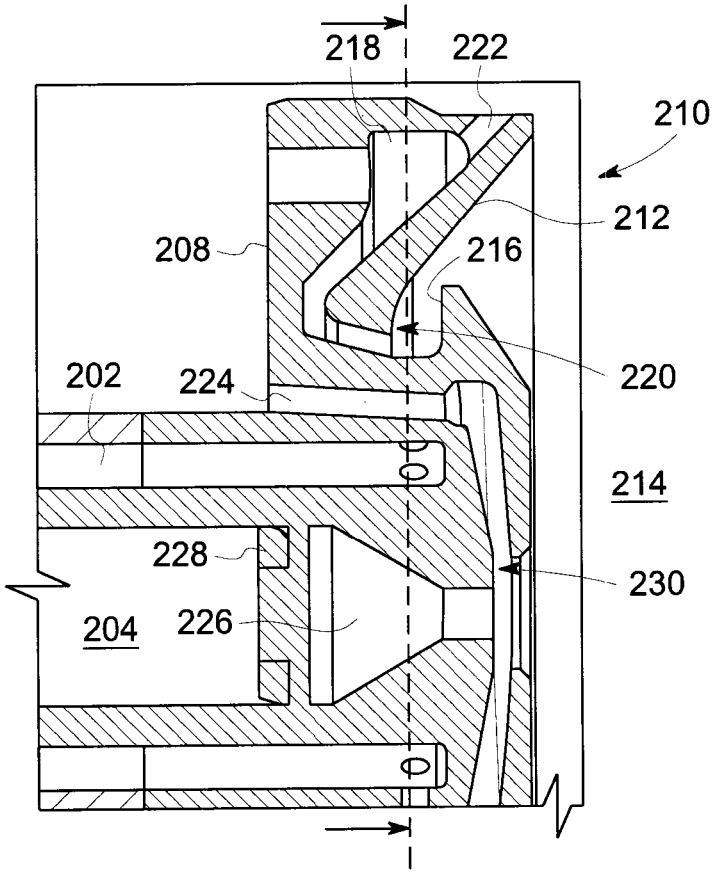
FIG. 3 schematically depicts a detailed view of a portion of the liquid fuel nozzle of FIG. 2 according to an embodiment.
Figure 4:
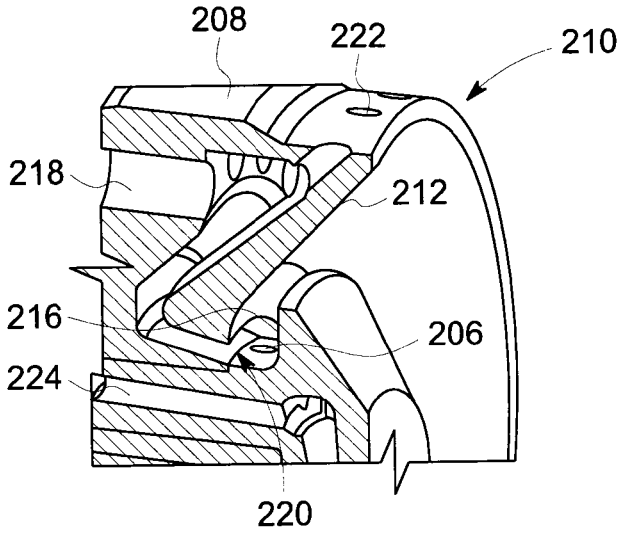
FIG. 4 schematically depicts a perspective view of a portion of the liquid fuel nozzle of FIG. 2 according to an embodiment.
Figure 5:
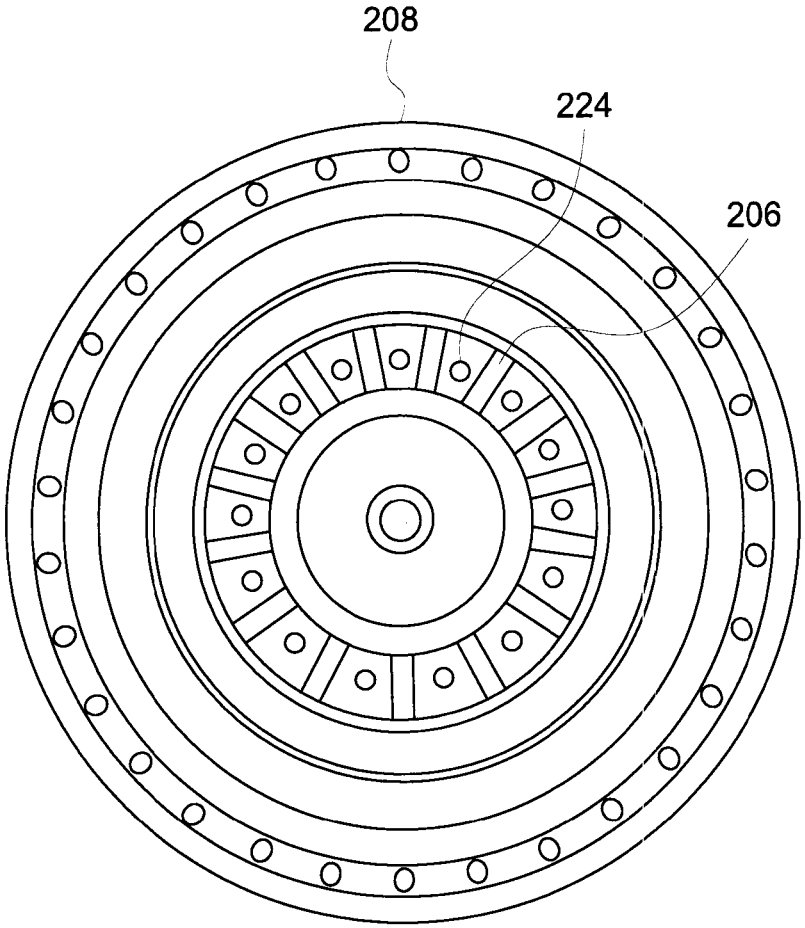
FIG. 5 schematically depicts a cross-sectional view of the liquid fuel nozzle of FIG. 3 according to an embodiment.

Turning now to the drawings, FIG. 1 depicts a schematic view of gas turbine engine 100 as may be used herein. The gas turbine engine 100 may include a compressor 102. The compressor 102 compresses an incoming flow of air 104. The compressor 102 delivers the compressed flow of air 104 to a combustor 106. The combustor 106 mixes the compressed flow of air 104 with a compressed flow of fuel 108 and ignites the mixture to create a flow of combustion gases 110. Although only a single combustor 106 is shown, the gas turbine engine 100 may include any number of combustors 106. The flow of combustion gases 110 is in turn delivered to a downstream turbine 112. The flow of combustion gases 110 drives the turbine 112 to produce mechanical work. The mechanical work produced in the turbine 112 drives the compressor 102 via a shaft 114 and an external load 116, such as an electrical generator or the like.

The gas turbine engine 100 may use natural gas, various types of syngas, and/or other types of fuels. The gas turbine engine 100 may be any one of a number of different gas turbine engines such as those offered by General Electric Company of Schenectady, N.Y. and the like. The gas turbine engine 100 may have different configurations and may use other types of components. Other types of gas turbine engines also may be used herein. Multiple gas turbine engines, other types of turbines, and other types of power generation equipment also may be used herein together.

FIGS. 2-5 depict a liquid fuel nozzle 200. The nozzle 200 may be incorporated into the combustor 106 of FIG. 1. In some instances, the combustor 106 may be a dual fuel combustor. For example, the combustor 106 may operate on a gas fuel (such as natural gas or the like) or a liquid fuel (such as oil or the like). In some instances, the combustor 106 may primarily operate on a gas fuel, with the liquid fuel being a backup fuel. When operating the combustor 106 using a liquid fuel, such as oil or the like, water may be injected into the liquid fuel to lower the combustion gas temperature and reduce NOx emissions. The nozzle 200 may be used when operating the combustor 106 on liquid fuel. In this manner, the nozzle 200 may be a backup nozzle. When the combustor 106 operates on gas fuel, the nozzle 200 may not be used.

The nozzle 200 may include a main fuel passage 202 and a pilot fuel passage 204. In some instances, the main fuel passage 202 and the pilot fuel passage 204 may be concentric, with the main fuel passage 202 disposed as an annulus about the pilot fuel passage 204. The main fuel passage 202 may include a flow of liquid fuel therein, such as oil or a mixture of oil and water, and the pilot fuel passage 204 may include a flow of liquid fuel therein, such as diesel fuel or the like.

The main fuel passage 202 may be in communication with a number of radial fuel ports 206. The radial fuel ports 206 may be disposed within a hub 208 forming a tip 210 of the nozzle 200. Any number of radial fuel ports 206 may be used. The hub 208 may include a prefilmer surface 212 in communication with the radial fuel ports 206. In this manner, the flow of liquid fuel may flow from the main fuel passage 202, through the radial fuel ports 206, and onto the prefilmer surface 212, where the liquid fuel may atomize while being injected into a combustion chamber 214 of the combustor 106. The nozzle 200 also may include a radial lip 216 spaced apart from the prefilmer surface 212 adjacent to the radial fuel ports 206. The radial lip 216 may direct the flow of liquid fuel exiting the radial fuel ports 206 into the prefilmer surface 212. The radial lip 216 and the prefilmer surface 212 may collectively form a cup-like nozzle.

Purge air may be provided to the tip 210 of the nozzle 200 by way of a main purge air passage 218. The main purge air passage 218 may be at least partially formed within the hub 208. The main purge air passage 218 may include a Z-like shape such that at least a portion of the main purge air passage 218 runs substantially along a backside of the prefilmer surface 212. The main purge air passage 218 may include a flow of purge air therein. The main purge air passage 218 may be in communication with the radial fuel ports 206 and the prefilmer surface 212. For example, the main purge air passage may include a first outlet 220 at a first end of the prefilmer surface 212 adjacent to the radial fuel ports 206. In some instances, the first outlet 220 may be an annular slot. The first outlet 220 may cool the tip 210 of the nozzle 200, provide an air curtain about the prefilmer surface 212, and/or force the liquid fuel away from the tip 210 of the nozzle 200. In addition, the main purge air passage 218 may include a number of second outlets 222 at a second end of the prefilmer surface 212 opposite the radial fuel ports 206. In some instances, the second outlets 222 may be a number of ports. The second outlets 222 may cool the tip 210 of the nozzle 200 and force the liquid fuel away from the tip 210 of the nozzle 200. Purge air passages and outlets protect surfaces of the nozzle tip exposed to hot combustion products when operating on gas fuel.

In some instances, the main purge air passage 218 may be at least partially disposed on a backside of the prefilmer surface 212 within the hub 208. In this manner, the main purge air passage 218 may cool the prefilmer surface 212.

The nozzle 200 also may include a number of pilot purge air passages 224 disposed within the hub 208. The pilot purge air passages 224 may be disposed between the radial fuel ports 206. In some instances, the pilot purge air passages 224 may be in communication with a pilot fuel nozzle 226, which may include one or more swirlers 228. The pilot purge air passage 224 may provide a flow of purge air to the pilot fuel nozzle 226. For example, the pilot purge air passage 224 may include an outlet 230 about the pilot fuel nozzle 226. The outlet 230 may cool the tip 210 of the nozzle 200 and force the liquid fuel away from the tip 210 of the nozzle 200. In some instances, the first outlet 220, the second outlet 222, and the outlet 230 may provide an air curtain about the tip 210 of the nozzle 200. In addition, the main purge air passage 218 and the pilot purge air passages 224 may receive air from the same circuit, such as air from the compressor 102.

In some instances, the radial fuel ports 206 may include varying diameters. Likewise, the pilot purge air passages 224 may include varying diameters. In this manner, the flow of liquid fuel and air to the combustion chamber 214 may be controlled to prevent wetting of the combustion liner. Wetting may damage the ceramic thermal barrier coating or the like or otherwise impair durability.

The nozzle reduces inertial separation of the oil and water by avoiding swirl or spinning of the mixed oil and water. For example, the main liquid fuel circuit does not exert a body force (swirl) on the oil/water mixture that would separate the lighter oil from the heavier water. This results in more efficient used of the water injection, as the water evaporates in the same spatial location where the oil evaporates and burns. The pilot liquid fuel circuit may be used from ignition, up to spinning reserve, and at low part-load. That is, the pilot liquid fuel circuit may be used for ignition, accelerating to full speed, and operation at low part-load. Otherwise, about 90% of the fuel and water may be provided by the main liquid fuel circuit.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A liquid fuel nozzle for a dual fuel combustor, the nozzle comprising:

an axial centerline, wherein a radial direction extends outwardly from, and perpendicular to, the axial centerline;

a main fuel passage;

a main purge air passage disposed outward along the radial direction from the main fuel passage, the main purge air passage comprising a first outlet and a plurality of second outlets;

a prefilmer surface diverging outward along the radial direction from a first end to a second end, wherein the first outlet is proximate the first end and the plurality of second outlets are proximate the second end;

a radial lip spaced apart from the prefilmer surface, wherein the radial lip extends beyond the first outlet and the first end and terminates at a free end;

a plurality of radial fuel ports positioned axially between the first outlet and the radial lip, wherein the plurality of radial fuel ports extend between the main fuel passage and the main purge air passage, wherein the radial lip is configured to direct a flow of liquid fuel exiting the radial fuel ports into the prefilmer surface.

2. The nozzle as in claim 1, wherein the first outlet of the main purge air passage is disposed immediately upstream from the radial fuel ports and oriented towards the radial lip.

3. The nozzle as in claim 2, wherein the first outlet of the main purge air passage is configured to provide an air curtain about the prefilmer surface.

4. The nozzle as in claim 1, wherein the free end is disposed both radially and axially between the first end and the second end of the of the prefilmer surface.

5. The nozzle of claim 1, wherein the main purge air passage is at least partially disposed on a backside of the prefilmer surface.

6. The nozzle as in claim 1, wherein the first outlet is an annular slot.

7. The nozzle as in claim 1, further comprising a pilot fuel passage positioned radially inward the main fuel passage, wherein the main fuel passage is disposed as an annulus about the pilot fuel passage.

8. The nozzle as in claim 7, wherein a plurality of pilot purge air passages are disposed circumferentially between the plurality of radial fuel ports.

9. The nozzle of claim 1, wherein the plurality of radial fuel ports comprise varying diameters.

10. The nozzle as in claim 1, wherein the main purge air passage is in communication with the plurality of radial fuel ports.

11. A gas turbine engine, comprising:

a compressor;

a turbine; and a combustor disposed downstream from the compressor and upstream from the turbine, the combustor including a nozzle disposed within the combustor, the nozzle comprising:

an axial centerline, wherein a radial direction extends outwardly from, and perpendicular to, the axial centerline;

a main fuel passage;

a main purge air passage disposed outward along the radial direction from the main fuel passage, the main purge air passage comprising a first outlet and a plurality of second outlets;

a prefilmer surface diverging outward along the radial direction from a first end to a second end, wherein the first outlet is proximate the first end and the plurality of second outlets are proximate the second end;

a radial lip spaced apart from the prefilmer surface, beyond the first outlet and the first end and terminates at a free end;

a plurality of radial fuel ports positioned axially between the first outlet and the radial lip, wherein the plurality of radial fuel ports extend between the main fuel passage and the main purge air passage, wherein the radial lip is configured to direct a flow of liquid fuel exiting the radial fuel ports into the prefilmer surface.

12. The gas turbine as in claim 11, wherein the first outlet of the main purge air passage is disposed immediately upstream from the radial fuel ports and oriented towards the radial lip.

13. The gas turbine as in claim 12, wherein the first outlet of the main purge air passage is configured to provide an air curtain about the prefilmer surface.

14. The gas turbine as in claim 11, wherein the free end is disposed both radially and axially between the first end and the second end of the of the prefilmer surface.

15. The gas turbine as in claim 11, wherein the main purge air passage is at least partially disposed on a backside of the prefilmer surface.

16. The gas turbine as in claim 11, wherein the first outlet is an annular slot.

17. The gas turbine as in claim 11, further comprising a pilot fuel passage positioned radially inward the main fuel passage, wherein the main fuel passage is disposed as an annulus about the pilot fuel passage.

18. The gas turbine as in claim 17, wherein a plurality of pilot purge air passages are disposed circumferentially between the plurality of radial fuel ports.

19. The gas turbine as in claim 18, wherein the plurality of pilot purge air passages comprise varying diameters.

20. The gas turbine as in claim 11, wherein the plurality of radial fuel ports comprise varying diameters.

* * * * *